United States Patent [19]

Masuda

[11] Patent Number: 5,026,037

[45] Date of Patent: Jun. 25, 1991

[54] COPYING MACHINE WITH MULTIPLE TRANSPORT FUNCTIONS INCLUSIVE OF DUPLEX AND COMPOSITE COPYING FROM AN INTERMEDIATE FEED TRAY BY SELECTIVES TOP OR BOTTOM FEED

[75] Inventor: Zitsuo Masuda, Yamatotakada, Japan

[73] Assignee: Sharp Kabushiki Kaisha, Osaka, Japan

[21] Appl. No.: 87,342

[22] Filed: Aug. 20, 1987

[30] Foreign Application Priority Data

Aug. 20, 1986 [JP] Japan ..... 61-127298[U]

[51] Int. Cl.[5] ..... G03G 15/21

[52] U.S. Cl. ..... 271/3.1; 271/9; 271/291; 271/301; 355/313; 355/319; 355/244

[58] Field of Search ..... 355/14 R, 14 SH, 3 SH, 355/23, 24; 271/3.1, 9, 186, 291, 301

[56] References Cited

U.S. PATENT DOCUMENTS 4,385,825 5/1983 Kaneko .

4,772,917 9/1988 Tani ..... 355/24

FOREIGN PATENT DOCUMENTS 159667 7/1986 Japan ..... 355/14 SH

*Primary Examiner*—R. L. Moses

*Attorney, Agent, or Firm*—Birch, Stewart, Kolasch & Birch

[57] ABSTRACT

A copying machine with multiple transport functions which contains a main transport route running from a paper feed block through a copy process block to a paper discharge block, an auxiliary transport route running from the paper discharge block through reversed transport section selectively reversing copy paper being transported and an intermediate tray for storing copy paper sheets temporarily, to the paper feed block, and a multiple copy mode selector switch for making the reversed transport section effective or ineffective when copy paper is passed through the auxiliary transport route.

The copying machine further includes two paper feed rollers, each driven independently and mounted on the upper and lower sides of the paper supply section of the intermediate tray, and a paper feed roller selecting switch which makes the upper feed roller drivable when the reversed transport section is made effective by the multiple copy mode selecting switch and which makes the lower paper feed roller drivable when the reversed transport section is made ineffective.

5 Claims, 4 Drawing Sheets

COPYING MACHINE WITH MULTIPLE TRANSPORT FUNCTIONS INCLUSIVE OF DUPLEX AND COMPOSITE COPYING FROM AN INTERMEDIATE FEED TRAY BY SELECTIVES TOP OR BOTTOM FEED

BACKGROUND OF THE INVENTION

The present invention relates to a copying machine with multiple transport functions, comprising a main transport route for leading copy paper from a paper feed block through a copy process block to a paper discharge block, an auxiliary transport route communicating the paper discharge block with the paper feed block, and reversed transport means provided in the auxiliary transport route and made effective or ineffective by multiple copy mode selecting means so that the copying machine is operated in the duplex copy mode or the composite copy mode.

Typically, a copying machine equipped with multiple copy mode selecting means contain a main transport route running from a paper feed block through a copy process block to a discharge block and an auxiliary transport route running from the discharge block back to the copy process block. However, paper feed means suitable to this type of copying machine has not yet been provided.

SUMMARY OF THE INVENTION

An object of the present invention is to provide a copying machine with multiple transport functions which contains two paper feed rollers provided adjacent an intermediate tray mounted the way of a transport route and which selects, from among the two paper feed rollers, the paper feed roller facing the image-carrying side of copy paper sheets that are stacked up in the intermediate tray with the image side up or down depending upon the selected multiple copy mode, whereby copy paper is supplied for the second copy process from the intermediate tray by the selected paper feed roller so that the image-carrying side of the paper being delivered is not rubbed by the next copy paper sheet in the intermediate tray.

Briefly described, in accordance with the present invention, a copying machine which contains a main transport route running from a paper feed block through a copy process block to a paper discharge block, an auxiliary transport route running from the paper discharge block through reversed transport means and an intermediate tray to the paper feed block. The reversed transport means selectively reverses the copy paper being transported, the intermediate tray stores copy paper sheets temporarily, and the multiple copy mode selecting means makes the reversed transport means effective or ineffective when copy paper is passed through the auxiliary transport route. The multiple copy mode selecting means comprises two paper feed rollers each driven independently and mounted on upper and lower sides of the paper supply section of the intermediate tray, and paper feed roller selecting means which selects the upper feed roller to be drivable when the reversed transport means is made effective by the multiple copy mode selecting means or selects the lower feed roller to be drivable when the reversed transport means is made ineffective.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE INVENTION

Figure 1:
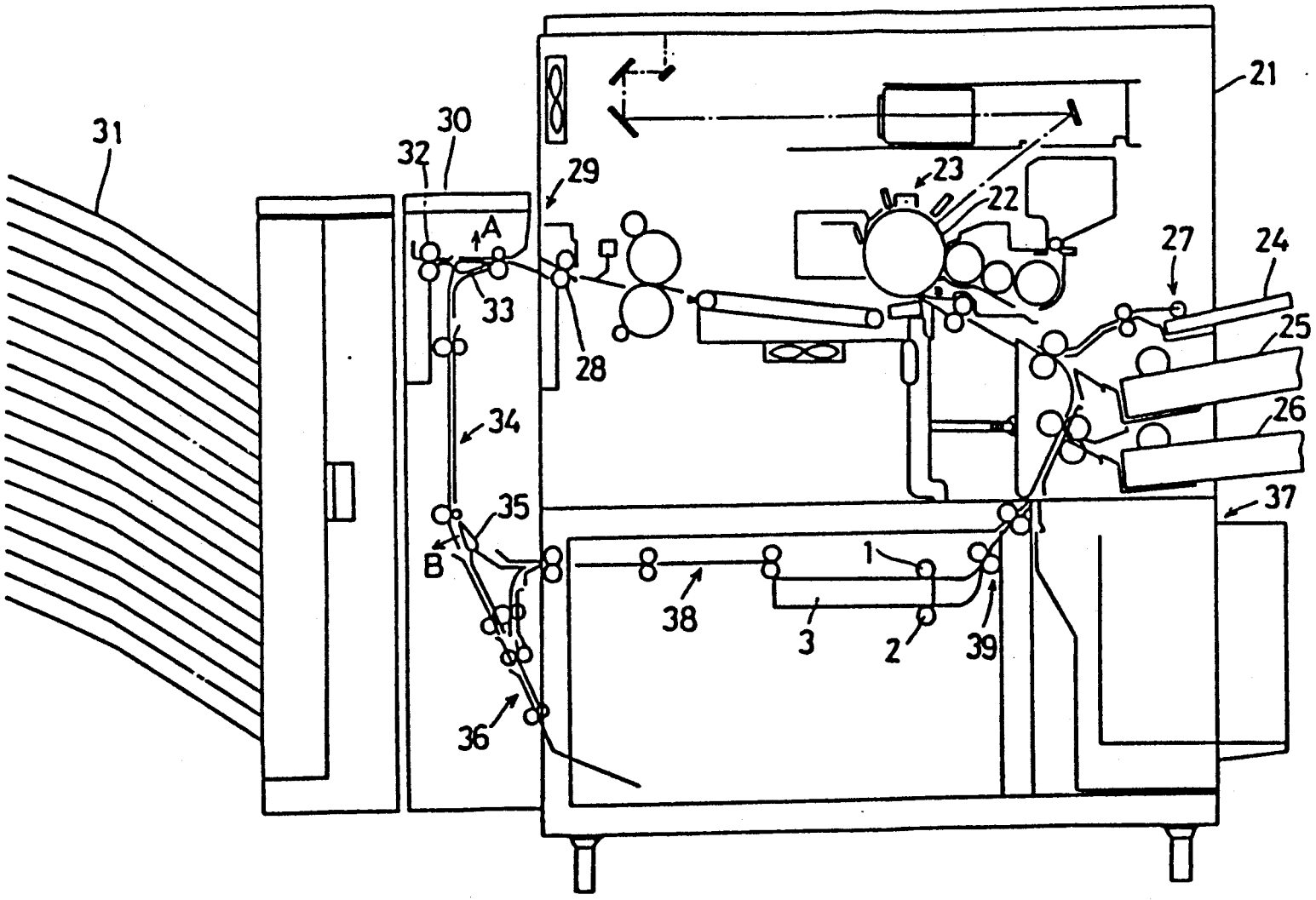
FIG. 1 is a schematic construction drawing of an embodiment of the copying machine with multiple transport functions of the present invention.

FIG. 1 shows the construction of an embodiment of the copying machine with multiple transport functions of the present invention.

A photoreceptor drum 22 is installed in the center of the copying machine main body 21 to constitute a copy process block 23. On the right of the copy process block 23 is a paper feed block 27 including a paper feed tray 24 and paper cassettes 25 and 26. A paper discharge block 29 including discharge rollers 28 is located at the left of the copy process block 23.

A sorter 30 is mounted outside the paper discharge block 29 of the copying machine main body 21. The sorter 30 has a bin 31 comprising a plurality of racks. Discharge rollers 32 located in the upper part of the sorter 30 direct discharged copy paper sheets to the bin 31. In the sorter 30, a flapper 33, a transport passage 34 and a paper reversing section 36 are arranged downwardly in this order. In the downstream of the transport passage 34 is provided another flapper 35 for selectively directing copy paper to the paper reversing section 36 or rightward to a cabinet 37 on which the copying machine main body 21 is placed.

An intermediate tray 3 is mounted in the cabinet 37. A paper transport passage 38 is formed between the transport passage 34 and the paper reversing section 36 and the intermediate tray 3. A paper transport passage 39 is formed on the paper supply side of the intermediate tray 3 so as to convey paper supplied from the intermediate tray 3 to the copy process block 23. Paper feed rollers 1 and 2 are mounted in the upper and lower sides, respectively, of the paper supply section of the intermediate tray 3. The paper travelling course from the paper feed block 27 via the copy process block 23 to the paper discharge block 29 is called a main transport route and that from the paper discharge block 29 via the intermediate tray 3 to the copy process block 23 is called an auxiliary transport route.

Figure 2:
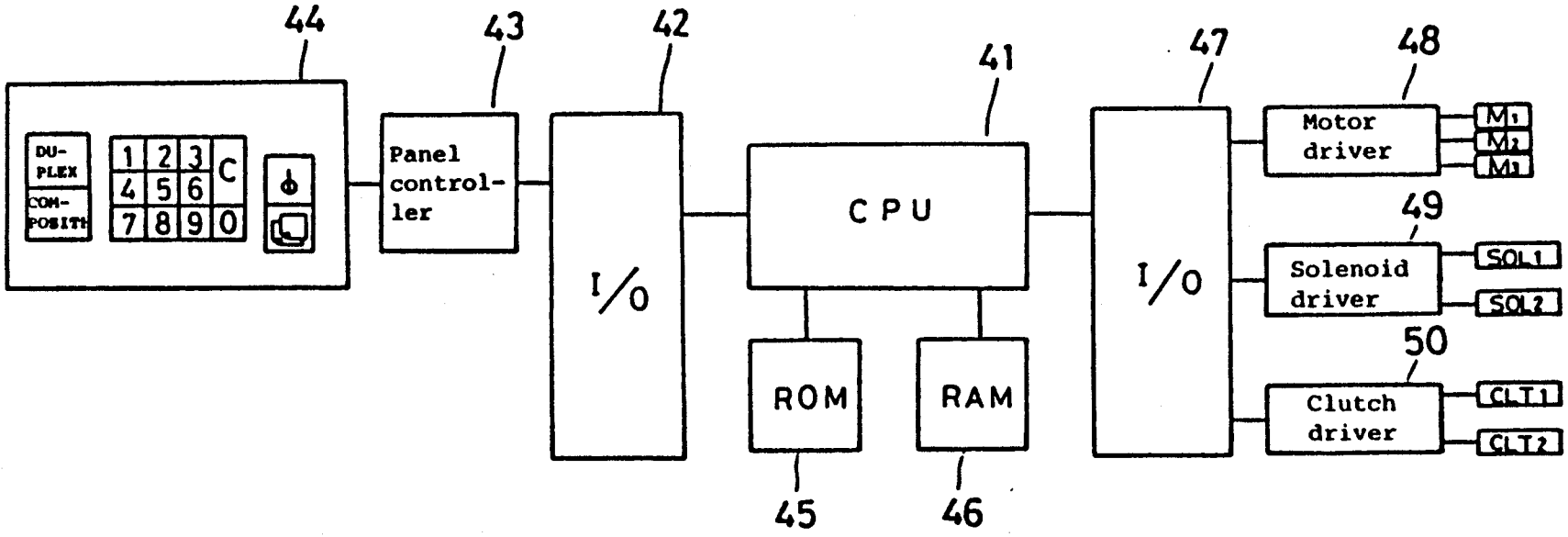
FIG. 2 is a block diagram showing the control section of the copying machine of FIG. 1.

FIG. 2 is a block diagram showing the control section of the copying machine with multiple transport functions of the present invention.

The copying process is controlled by a CPU 41. The control program is stored in advance in a ROM 45. A RAM 46 is used as the working area for the control program. Copying data are input from an operation panel 44 into the CPU 41 through a panel controller 43 and an I/O interface 42. The copying data include manuscript size, copy paper size, selected code representing either the duplex copy mode or the composite copy mode, desired number of copies, etc. The CPU 41 outputs driving data through an I/O interface 47 to a motor driver 48, a solenoid driver 49 and a clutch driver 50. The motor driver 48 actuates motors $M_1$, $M_2$ and $M_3$ according to the data output from the CPU 41. The motors $M_1$, $M_2$ and $M_3$ actuate the transport rollers in the main body, the transport rollers in the sorter 30 and the paper feed rollers in the cabinet 37, respectively. The solenoid driver 49 operates solenoids SOL1 and SOL2 according to the data output from the CPU 41. Similarly, the clutch driver 50 operates clutches CLT1 and CLT2 according to the data output from the CPU 41. The solenoids SOL1 and SOL2 actuate the flappers 33 and 35, respectively. The clutches CLT1 and CLT2 drive the upper and lower paper feed rollers 1 and 2, respectively, to be lifted off the paper supply section of the intermediate tray 3.

Figure 3A:
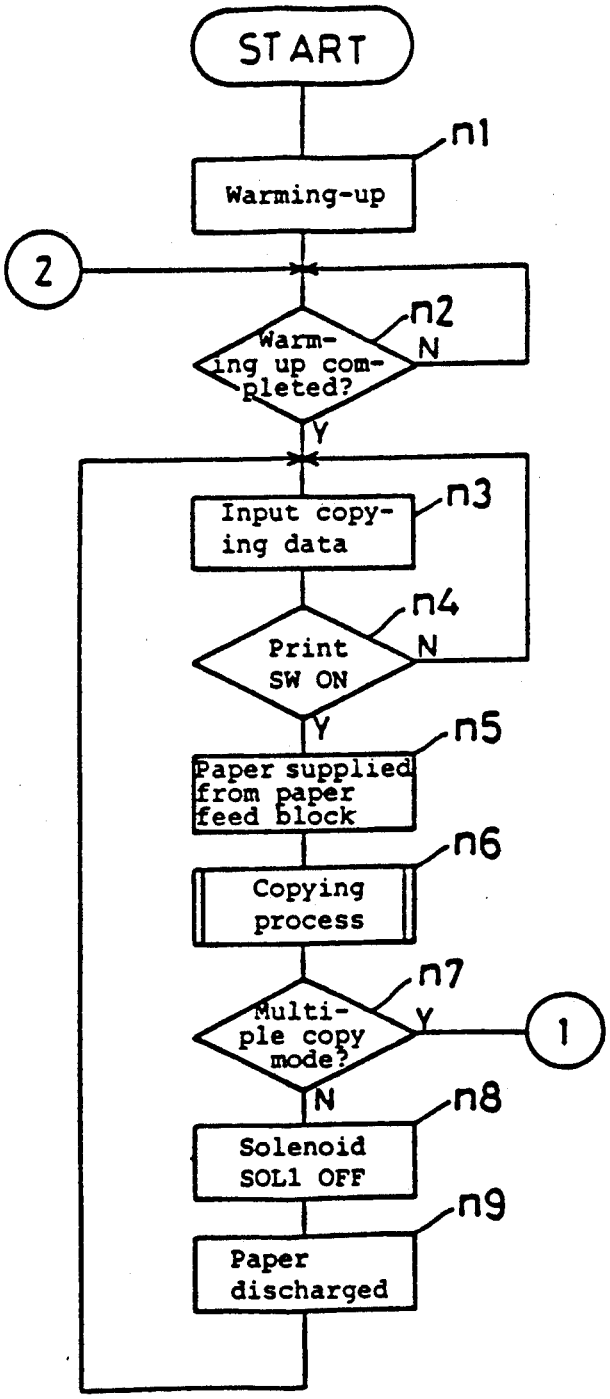
FIGS. 3(A) and 3(B) are flow charts showing the operation of the copying machine of FIG. 1.
Figure 3B:
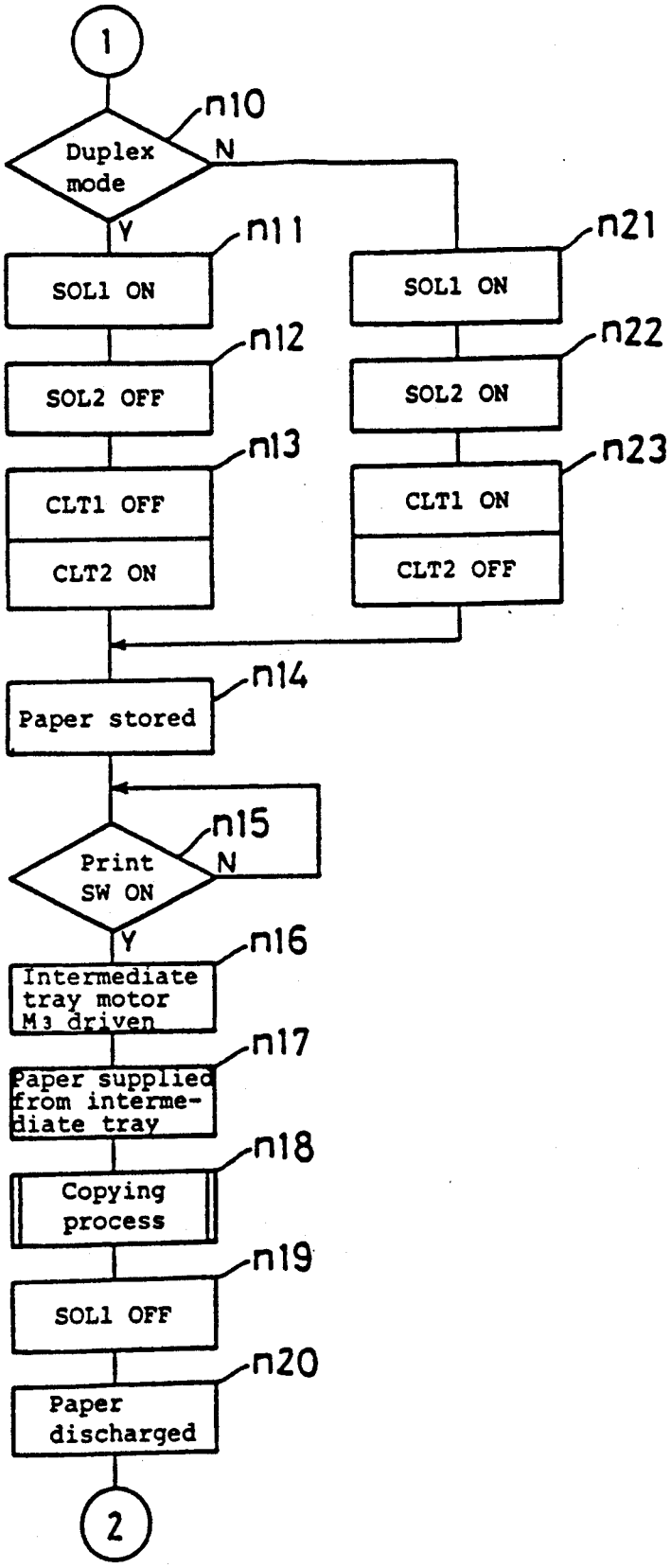

FIGS. 3(A) and 3(B) are flow charts showing the operation of the copying machine of the present invention.

When the power switch is turned ON, the copying machine is warmed up at the step n1 (in the subsequent description, step n1 is simply represented as n1). Whether warm-up operation is completed or not is judged at n2. Copying data is input at n3. Whether print switch is turned ON or OFF is judged at n4.

If print switch is found to be ON at n4, the operation proceeds to n5 where paper is supplied from the paper feed block 27. The copying process is carried out at n6. After completion of the copying process for one copy in n6, the operation proceeds to n7 where it is judged whether the multiple, copy mode is selected or not. If it is found that the multiple copy mode is not selected, that is, when the ordinary single-side copy mode is selected, the operation proceeds to n8 where the solenoid SOL1 is turned OFF. Then, at n9, the copy paper is discharged out of the copying machine, thus completing the single-sided copy operation.

If the multiple copy mode is found to be selected at n7, the operation skips to n10 where it is judged whether the duplex copy mode is selected or not. If duplex copy mode is found to be selected, the operation proceeds to n11 to turn ON solenoid SOL1 whereby the flapper 33 is shifted in the direction indicated by arrow A in FIG. 1, leading the copy paper in the direction of the transport passage 34. In n12, the solenoid SOL2 is turned OFF, permitting the copy paper to travel via the paper reversing section 36 onto the paper transport passage 38 in the cabinet 37. Then at n13, the clutch CLT1 is turned OFF and the clutch CLT2 is turned ON so that the lower paper feed roller 2 is lifted off the paper supply section of the intermediate tray 3. At n14, copy paper sheets with an image formed on one side are stored in the intermediate tray 3. When the print switch is operated at n15 to instruct paper supply from the intermediate tray 3, the operation proceeds to n16 where the appropriate paper feed roller is actuated by the motor $M_3$ mounted at the paper supply section of the intermediate tray 3, and then to n17 where the copy paper supplied by means of the paper feed roller is led through the transport passage 39 to the copy process block 23. When the copying operation for one copy is completed at n18, the solenoid SOL1 is turned OFF at n19 to lead the copy paper sheet from the discharge block 29 to the discharge rollers 32. Then at n20, the copy paper sheet is delivered by the discharge rollers 32 to the bin 31.

If the duplex copy mode is found not to be selected at n10, that is, when the composite copy mode is selected, the operation proceeds to n21 where the solenoid SOL1 is turned ON, whereby the flapper 33 is shifted in the direction indicated by arrow A, permitting the copy paper to be sent out through the discharge rollers 28 and directed to the transport passage 34. Then, at n22, the solenoid SOL2 is turned ON to shift the flapper 35 in the direction indicated by arrow B, allowing the copy paper to travel on the transport passage 38 to the intermediate tray 3. At n23, the clutch CLT1 is turned ON so that the upper paper feed roller 1 is lifted off the paper supply section of the intermediate tray 3. Thus, when the duplex copy mode is not selected, the copy paper having an image on one side is directly led through the transport passages 34 and 38 to the intermediate tray 3 without passing through the paper reversing section 36. After the step n23, the operation proceeds to n14 and the subsequent steps.

In the operation described above, the steps n13 and n23 correspond to the paper feed roller selecting means of the present invention. According to the present invention, in the duplex copy mode, the copy paper, on which image has been transferred by the first copy process, is sent through the paper reversing section to the intermediate tray in which the copy paper is stored with the image side facing up, and the copy paper is supplied, for the second copy process, from the intermediate tray by means of the upper paper feed roller. In the composite copy mode, on the other hand, the copy paper is sent directly to the intermediate tray without passing through the paper reversing section, and stored in the tray with the image side facing down. For the second copy process, the paper is supplied from the intermediate tray by means of the lower paper feed roller. It is understood, therefore, that the copy paper is always supplied, for the second copy process, by the paper feed roller facing the image-carrying side of the copy paper sheets stacked in the intermediate tray, so that the image-carrying side of the copy paper is never rubbed by the rest of the copy paper in the intermediate tray when it is being taken away from the intermediate tray for the second copy process. The present invention therefore eliminates the possibility that toner of the image on the copy paper delivered from the intermediate tray would stick to and soil the surface of the next copy paper when the second copy process is carried out.

According to the present invention, as understood from the above, the reversed transport means is made effective or ineffective according to the copy mode selected by the multiple copy mode selecting means. When the reversed transport means is made effective (for the duplex copy mode), it is possible to actuate the upper paper feed roller of the two paper feed rollers mounted at the upper and lower sides of the paper supply section of the intermediate tray. In the duplex copy mode, therefore, the copy paper sheets having an image formed on one side thereof are stacked up in the intermediate tray with the image side facing the upper paper feed roller which is driven to supply copy paper for the second copying process. In contrast, when the reversed transport means is made ineffective (for composite copy mode), it is possible to actuate the lower paper feed roller alone. In the composite copy mode, therefore, copy paper sheets having an image formed on one side are stacked up in the intermediate tray with the image side facing the lower paper feed roller which is driven to supply copy paper for the second copying process.

In the copying machine with multiple transport functions of the present invention, the reversed transport means is made effective or ineffective by the multiple copy mode selecting means, and, of the two paper feed rollers disposed in the upper and lower sides of the paper supply section of the intermediate tray, the one facing the image-carrying side of the copy paper sheets in the intermediate tray is made drivable. In the composite copy mode or duplex copy mode, therefore, it is possible to supply copy paper from the intermediate tray for the second copying process without making the toner image-carrying side of the copy paper in contact with another copy paper in the intermediate tray. It is clear from the above description, therefore, that whatever copy mode may be selected, copy paper sheets, when taken away from the intermediate tray, never soil the next copy paper with toner of the image formed on each copy paper in the first copying process.

While only certain embodiments of the present invention have been described, it will be apparent to those skilled in the art that various changes and modifications may be made therein without departing from the spirit and scope of the present invention as claimed.

What is claimed is:

1. A copying machine with multiple transport functions and multiple copying modes capable of operating a composite copy mode ad duplex copy mode utilizing a single intermediate copy tray which comprises a main transport path running from a paper feed means through a copy process station to a paper discharge means, an auxiliary transport path running from said paper discharge means by way of said intermediate copy tray to said paper feed means, either through a path which includes a reverse transport means which selectively reverses a copy paper during said duplex copy mode or, directly to said intermediate copy tray avoiding said reverse transport means during said composite copy mode, a multiple copy mode selecting means for selecting which of said duplex or composite copy modes is to be implemented when said copy paper is passed through said auxiliary transport path, an intermediate copy tray having a paper supply section with two paper feed rollers each capable of being driven independently disposed adjacent to upper and lower sides of said paper supply section of said intermediate copy tray and paper feed roller selecting means which selects one of said two paper feed rollers to be driven depending upon which copy mode has been selected by said multiple copy mode selecting means, wherein whether in the composite copy mode or the duplex copy mode, copy paper sheets having a toner image formed on one side thereof are delivered from said intermediate copy tray by a paper feed roller facing the image-carrying side of said copy paper sheets in said intermediate copy tray, so that said toner image on each copy paper does not stick to and soil another copy paper in said intermediate copy tray.

2. The copying machine of claim 1, wherein said two paper feed rollers disposed in said upper and lower sides of said paper supply section of said intermediate copy tray are activated selectively by said paper feed roller selecting means such that said upper feed roller is driven when said reverse transport means is made effective by said multiple copy mode selecting means and said lower feed roller is driven when said reverse transport means is made ineffective.

3. A method for performing composite copying or duplex copying utilizing a single intermediate copy tray which comprises providing a copying machine with multiple transport functions and multiple copying modes capable of operating in a composite mode and duplex copying mode utilizing a single intermediate copy tray;

introducing a copy paper to a main transport path running from a paper feed means through a copy process station to a paper discharge means, discharging said copy paper to an auxiliary transport path running form said paper discharge means to said single intermediate copy tray, selecting by way of a multiple copy mode selecting means which of said duplex copying mode or composite copying mode is to be implemented when said copy paper is passed through said auxiliary transport path, directing said copy paper directly to said intermediate copy tray when said composite copying mode is selected or to said reversal transport means for reversing the copy paper when said duplex copying mode is selected from whence said inverted copy paper is directed to said intermediate copy tray;

providing said intermediate copy tray having a paper supply section with two paper feed rollers, each capable of being driven independently, disposed adjacent to upper and lower sides of said paper supply section of said intermediate copy tray, and selecting by way of a paper feed roller selecting means which of said two paper feed rollers is to be driven determined by which of said two copying modes is selected in response to said copy mode selecting means such that said upper feed roller is driven when said reverse transport means is functional during said duplex copying and said lower feed roller is driven when said copy sheet is sent directly to said intermediate copy tray during said composite copying mode.

4. The method of claim 3, wherein aid copying mode selected is the composite copying mode and said copy sheet is directed directly to said intermediate copy tray and said lower feed roller is activated returning said copy sheet to said paper feed means of said copying machine.

5. The method of claim 3, wherein said copying mode selected is said duplex copying mode and said copy sheet is directed to said reversal transport means before being introduced to said intermediate copy tray at which said upper feed roller is activated returning said copy sheet to said paper feed means of said copying machine.

* * * * *